US009188901B2

(12) United States Patent
Nakamura et al.

(10) Patent No.: US 9,188,901 B2
(45) Date of Patent: Nov. 17, 2015

(54) IMAGE FORMING APPARATUS INCLUDING A COVERED RETRACTING MECHANISM

(71) Applicants: Kenji Nakamura, Osaka (JP); Kohta Sakaya, Hyogo (JP); Kuniyori Takano, Kanagawa (JP); Jong Ho Park, Seoul (KR); Min Jae Chung, Seoul (KR)

(72) Inventors: Kenji Nakamura, Osaka (JP); Kohta Sakaya, Hyogo (JP); Kuniyori Takano, Kanagawa (JP); Jong Ho Park, Seoul (KR); Min Jae Chung, Seoul (KR)

(73) Assignee: Ricoh Company, Limited, Tokyo (JP)

( * ) Notice: Subject to any disclaimer, the term of this patent is extended or adjusted under 35 U.S.C. 154(b) by 82 days.

(21) Appl. No.: 14/070,980

(22) Filed: Nov. 4, 2013

(65) Prior Publication Data

US 2014/0147166 A1 May 29, 2014

(30) Foreign Application Priority Data

Nov. 28, 2012 (JP) ..... 2012-259983

(51) Int. Cl.
*G03G 15/00* (2006.01)
*G03G 15/04* (2006.01)
*G03G 21/16* (2006.01)

(52) U.S. Cl.
CPC .... *G03G 15/04054* (2013.01); *G03G 15/04036* (2013.01); *G03G 21/1666* (2013.01)

(58) Field of Classification Search
CPC ..... G03G 15/04036
USPC ..... 399/111, 110, 118
See application file for complete search history.

(56) References Cited

U.S. PATENT DOCUMENTS

| | | | | |
|---|---|---|---|---|
| 5,978,626 | A * | 11/1999 | Nagamine et al. | 399/110 |
| 8,265,520 | B2 * | 9/2012 | Irie et al. | 399/110 |
| 2008/0145103 | A1 | 6/2008 | Honobe et al. | |
| 2010/0021200 | A1 * | 1/2010 | Kato | 399/111 |
| 2011/0255905 | A1 * | 10/2011 | Yokoi | |
| 2013/0136496 | A1 | 5/2013 | Kato | |

FOREIGN PATENT DOCUMENTS

| | | |
|---|---|---|
| JP | 2006-018127 | 1/2006 |
| JP | 2008-020845 | 1/2008 |
| JP | 2008-143010 | 6/2008 |
| JP | 2010-032649 | 2/2010 |

* cited by examiner

*Primary Examiner* — Susan Lee
(74) *Attorney, Agent, or Firm* — Harness, Dickey & Pierce, P.L.C.

(57) ABSTRACT

An image forming apparatus includes: an image carrier unit that includes an image carrier and is configured to be capable of being housed in and removed from an image-forming-apparatus main body; an exposure device that is arranged close to the image carrier to form an electrostatic latent image; a retracting mechanism that holds the exposure device close to the image carrier when the image carrier unit is housed in the image-forming-apparatus main body, and holds the exposure device away from the image carrier when the image carrier unit is being removed from the image-forming-apparatus main body; a covering member that covers the retracting mechanism in a state where backlash of the exposure device at least in a main-scanning direction is allowed; and a guide mechanism that positions the exposure device in the main-scanning direction when the exposure device comes closer to the image carrier through the retracting mechanism.

11 Claims, 10 Drawing Sheets

(a)

(b)

(a)

(b)

IMAGE FORMING APPARATUS INCLUDING A COVERED RETRACTING MECHANISM

CROSS-REFERENCE TO RELATED APPLICATIONS

The present application claims priority to and incorporates by reference the entire contents of Japanese Patent Application No. 2012-259983 filed in Japan on Nov. 28, 2012.

BACKGROUND OF THE INVENTION

1. Field of the Invention

The present invention relates to an electrophotographic image forming apparatus, such as a copier, a printer, a facsimile machine, and a multifunction peripheral including these.

2. Description of the Related Art

Some of electrophotographic image forming apparatuses, such as a copier, a printer, a facsimile machine, and a multifunction peripheral including these, are equipped with a unit body (a process cartridge) into which a developing unit and a photosensitive element unit are integrated.

In such image forming apparatuses, the process cartridge needs to be periodically replaced with a new one due to running out of toner or deterioration of a part such as the photosensitive element unit. Furthermore, some of the electrophotographic image forming apparatuses use an LED head in an exposure device; in such image forming apparatuses, a user has to open an upper cover installed on top of the main body of the image forming apparatus to replace the process cartridge.

Further, the LED head is located on a trajectory of the process cartridge when it is taken out. Therefore, as a method to replace the process cartridge, conventionally, the user has to bring an LED into a state where it is retracted away from a mounting position after or at the same time that the user opens the upper cover installed on top of the main body of the image forming apparatus, in order to take out the process cartridge from the main body of the image forming apparatus.

That is, because of the short focal length of the LED head, it is necessary to place the LED head such that an area irradiated by the LED head is located close to a photosensitive element. Therefore, in the replacement of the process cartridge or in the handling of a jam, the LED head needs to be retracted away from the photosensitive element.

As a method to retract the LED head away from the photosensitive element, there is already known a method in which a retracting mechanism is provided, and retract the LED head is retracted from and brought into contact with the photosensitive element in conjunction with opening-closing movement of the cover. As an example of the retracting mechanism, a link mechanism may be installed at an end of the LED head in a main-scanning direction. Furthermore, conventionally, there is proposed an image forming apparatus configured to be able to position an LED head without backlash (Japanese Patent Application Laid-open No. 2008-020845). This image forming apparatus includes a sliding member which can move between a close position for bringing the LED head close to a photosensitive element and a distant position for holding the LED head away from the photosensitive element, a positioning body which has a shaft not parallel to a moving direction of the sliding member, and a guide face which is formed approximately parallel to a shaft direction of the positioning body.

However, if the retracting mechanism is installed, a user may sometimes touch the retracting mechanism.

In view of this, there is a need to provide an image forming apparatus that includes a retracting mechanism of an exposure device and a covering member for covering the retracting mechanism, and can position the exposure device with respect to a photosensitive element (an image carrier) even if backlash of the photosensitive element (the image carrier) in a main-scanning direction (a longitudinal direction) is generated in the exposure device.

SUMMARY OF THE INVENTION

It is an object of the present invention to at least partially solve the problems in the conventional technology.

An image forming apparatus includes: an image carrier unit that includes at least an image carrier and is configured to be capable of being housed in and removed from an image-forming-apparatus main body; an exposure device as a light source that is arranged close to the image carrier to form an electrostatic latent image; a retracting mechanism that holds the exposure device close to the image carrier when the image carrier unit is housed in the image-forming-apparatus main body, and holds the exposure device away from the image carrier when the image carrier unit is being removed from the image-forming-apparatus main body; a covering member that covers the retracting mechanism in a state where backlash of the exposure device at least in a main-scanning direction is allowed; and a guide mechanism that positions the exposure device in the main-scanning direction when the exposure device comes closer to the image carrier through the retracting mechanism.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 2(*a*) is a perspective view of the side walls with guide plate members attached, viewed from the left front, and FIG. 2(*b*) is a perspective view of the side walls with the guide plate members removed, viewed from the left front;

FIG. 3(*a*) is a perspective view of the side walls with the guide plate members attached, viewed from the right front, and FIG. 3(*b*) is a perspective view of the side walls with the guide plate members removed, viewed from the right front;

FIG. 12(*a*) is an explanatory diagram of a state when a male part is beginning to be fitted in an entrance tapered portion of a female part, FIG. 12(*b*) is an explanatory diagram of a state when the male part is beginning to be fitted in a male-part fitting portion of the female part, and FIG. 12(*c*) is an explanatory diagram of a state when the male part is being fitted in the male-part fitting portion of the female part;

FIG. 14(*a*) is an explanatory diagram of a state when a male part is beginning to be fitted in an entrance tapered portion of a female part, FIG. 14(*b*) is an explanatory diagram of a state when the male part is beginning to be fitted in a male-part fitting portion of the female part, and FIG. 14(*c*) is an explanatory diagram of a state when the male part is being fitted in the male-part fitting portion of the female part.

DETAILED DESCRIPTION OF THE PREFERRED EMBODIMENTS

An embodiment of the present invention will be explained below with reference to accompanying drawings.

Figure 1:
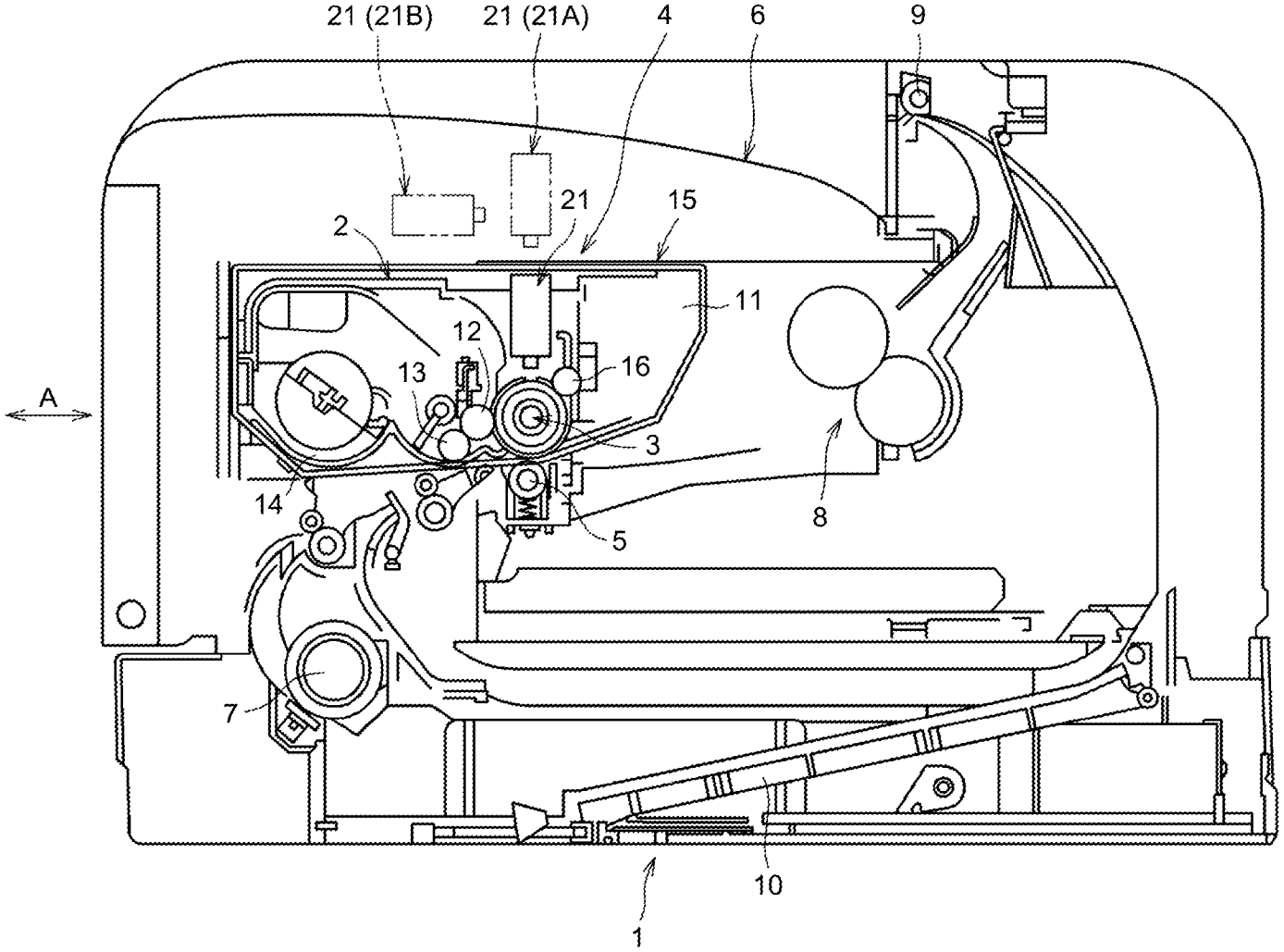
FIG. 1 is a configuration diagram of an entire image forming apparatus according to an embodiment.

FIG. 1 is a schematic configuration diagram showing a black-and-white electrophotographic image forming apparatus in cross-section at the center. This image forming apparatus includes a toner cartridge 2 roughly in the central part of an image-forming-apparatus main body 1. An exposure device 4 for forming a latent image on a photosensitive element 3 is placed within the toner cartridge 2.

A transfer roller 5 is placed under the toner cartridge 2. A paper cassette 10 in which recording media, such as sheets of paper, are loaded and contained is placed below the transfer roller 5. A reference numeral 7 denotes a paper feeder, 8 denotes a fixing device, 9 denotes a discharge device, and 6 denotes a discharge tray.

The toner cartridge 2 is composed of at least a developing unit 13 and a toner replenishing unit 14. The developing unit 13 includes a developing roller 12 that supplies toner to the photosensitive element 3 of a photosensitive element unit 11 to form a toner image on the surface of the photosensitive element 3. The toner replenishing unit 14 supplies toner to the developing unit 13. Incidentally, the developing roller 12 is driven to rotate by the photosensitive element 3.

Here, the toner cartridge 2 is integrated with the photosensitive element unit 11 with a charging roller 16, etc., and the toner cartridge 2 and the photosensitive element unit 11 compose an image carrier unit 15 which is generally called a process cartridge. The image carrier unit (process cartridge) 15 is removably attached to the image-forming-apparatus main body 1, and the image carrier unit (process cartridge) 15 can be attached and removed in a direction of an arrow A shown in FIG. 1.

A recording sheet is fed toward between the photosensitive element 3 and the transfer roller 5 by the paper feeder 7. The photosensitive element 3 rotates, and a photosensitive layer on the surface of the photosensitive element 3 is uniformly charged to high potential by the charging roller 16. Incidentally, driving the photosensitive element 3 and the developing roller 12 to rotate will be described later.

The photosensitive layer of the photosensitive element 3 is exposed to a light by the exposure device 4, and an electrostatic latent image is formed on the surface of the photosensitive element 3 by a low-potential portion where the potential is lowered by the exposure and a high-potential portion which was not exposed to the light.

Then, when a portion of the photosensitive element 3 on which the electrostatic latent image has been formed reaches a position opposed to the developing roller 12 in accordance with the rotation of the photosensitive element 3, toner is transferred from the developing roller 12 to the photosensitive layer of the photosensitive element 3, thereby the electrostatic latent image is developed, and a toner image is formed on the surface of the photosensitive element 3.

The toner image attached onto the surface of the photosensitive element 3 is transferred onto the recording sheet being passing between the photosensitive element 3 and the transfer roller 5, by the transfer roller 5 shown in FIG. 1. The recording sheet is led into the fixing device 8, and the toner image is fixed on the recording sheet by the application of heat and pressure. After that, the recording sheet on which the toner image has been fixed is discharged onto the discharge tray 6 by the discharge device 9.

After the transfer of the toner image from the photosensitive element 3 to the recording sheet and while the photosensitive element 3 is rotating, residual toner on the surface of the photosensitive element 3 is cleaned by a cleaning blade 17, and residual electric charge on the surface of the photosensitive element 3 is eliminated by a static eliminator (not shown) to prepare for the next toner image formation.

Figure 2:
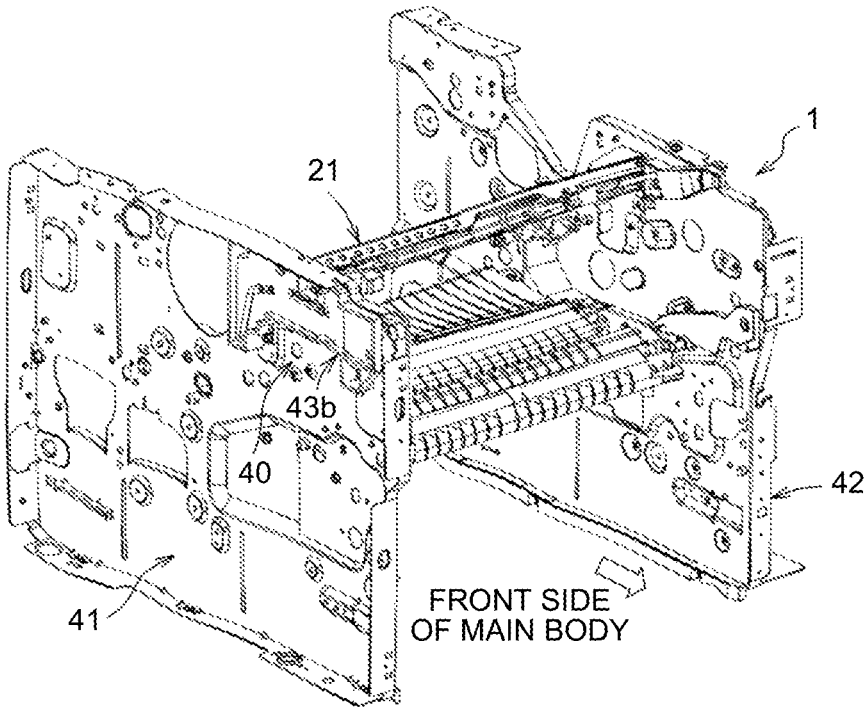
FIG. 2 shows side walls of a main body of the image forming apparatus shown in FIG. 1.
Figure 2:
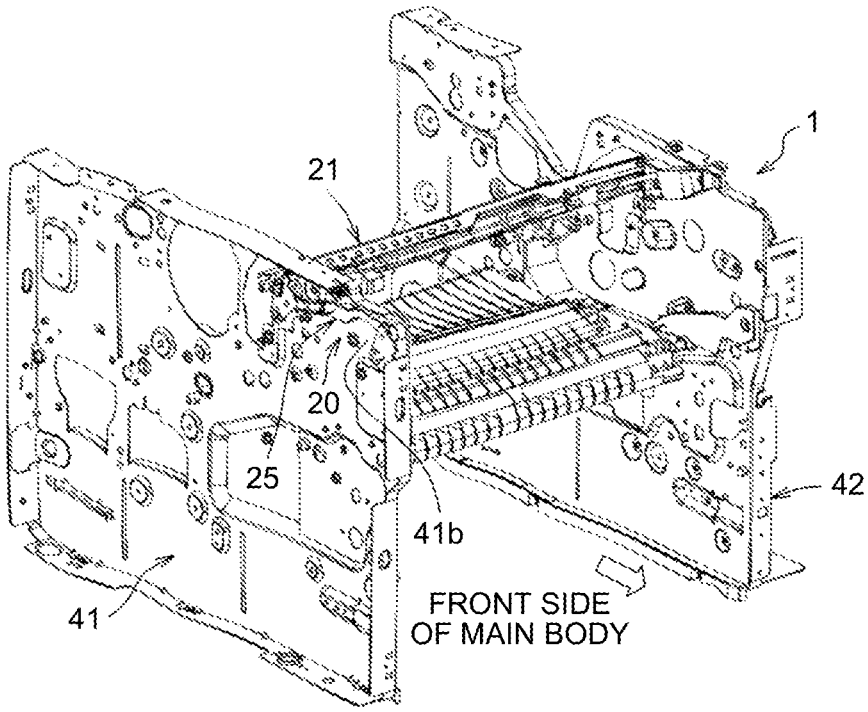

This image forming apparatus includes a retracting mechanism 20 (see FIGS. 2(*b*) and 3(*b*), etc.). The retracting mechanism 20 holds the exposure device 4 close to the photosensitive element 3 provided as an image carrier when the image carrier unit 15 is housed in the image forming apparatus, and moves the exposure device 4 away from the photosensitive element 3 when the image carrier unit 15 is being housed into or removed from the image forming apparatus.

Figure 4:
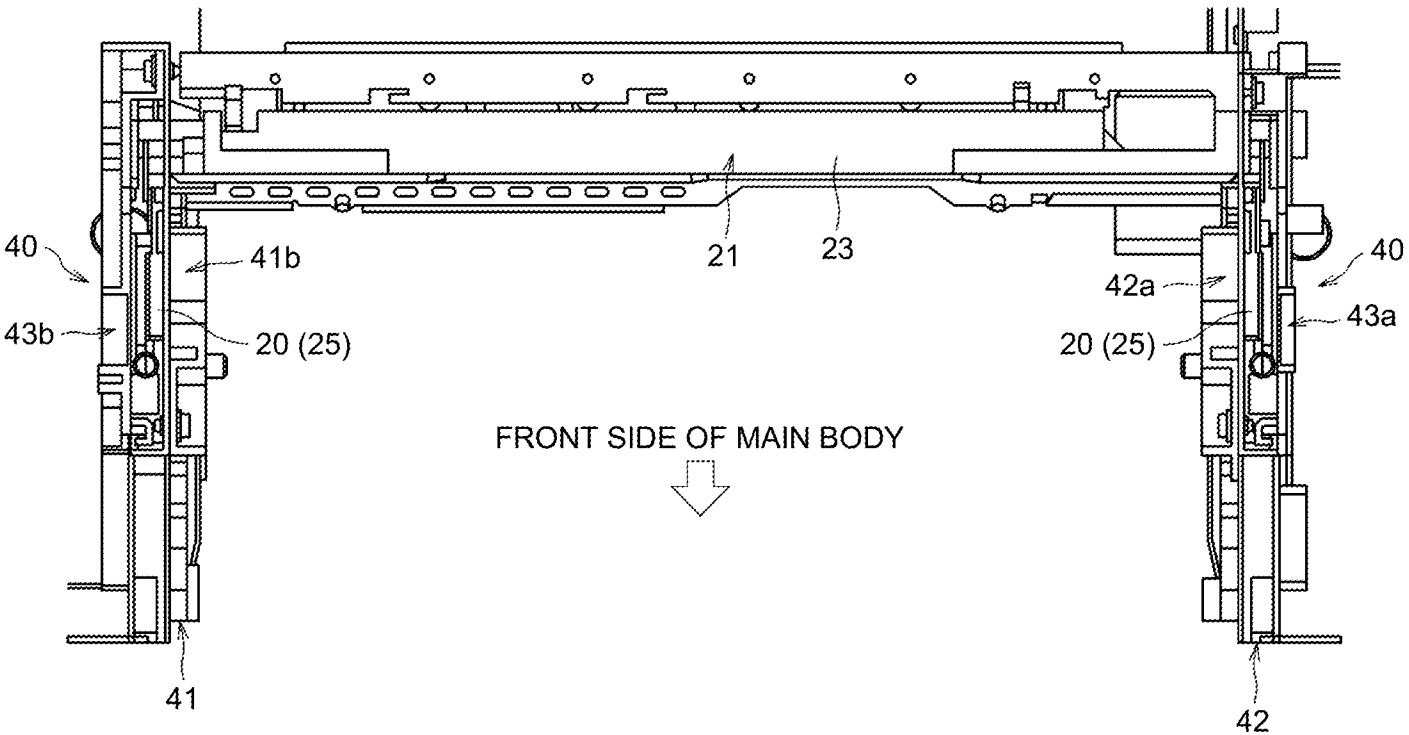
FIG. 4 is a front view of the side walls of the main body of the image forming apparatus shown in FIG. 1.
Figure 5:
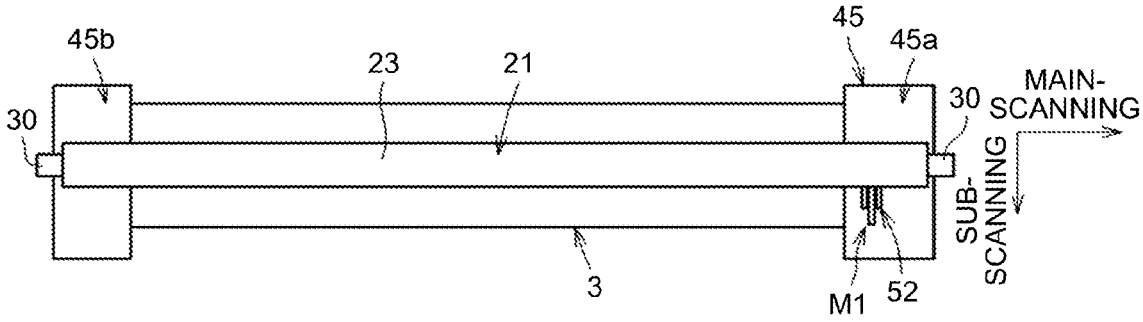
FIG. 5 is a plan view showing a relationship between an image carrier unit and an exposure device.
Figure 6:
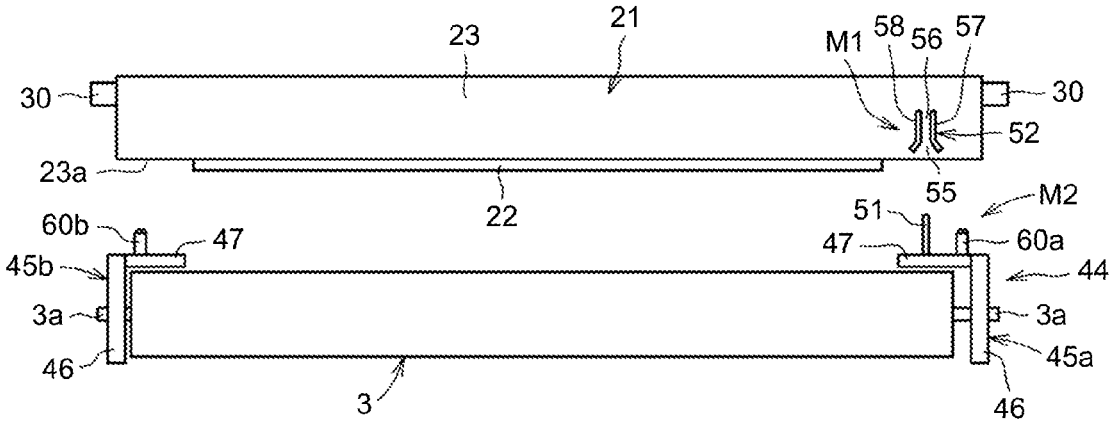
FIG. 6 is a front view showing the relationship between the image carrier unit and the exposure device.

As shown in FIGS. 4 to 6, etc., the exposure device 4 uses an LED array head 21. The LED array head 21 includes a light emitting unit 22 and an LED frame 23 which holds the light emitting unit 22 together with its substrate.

Figure 3:
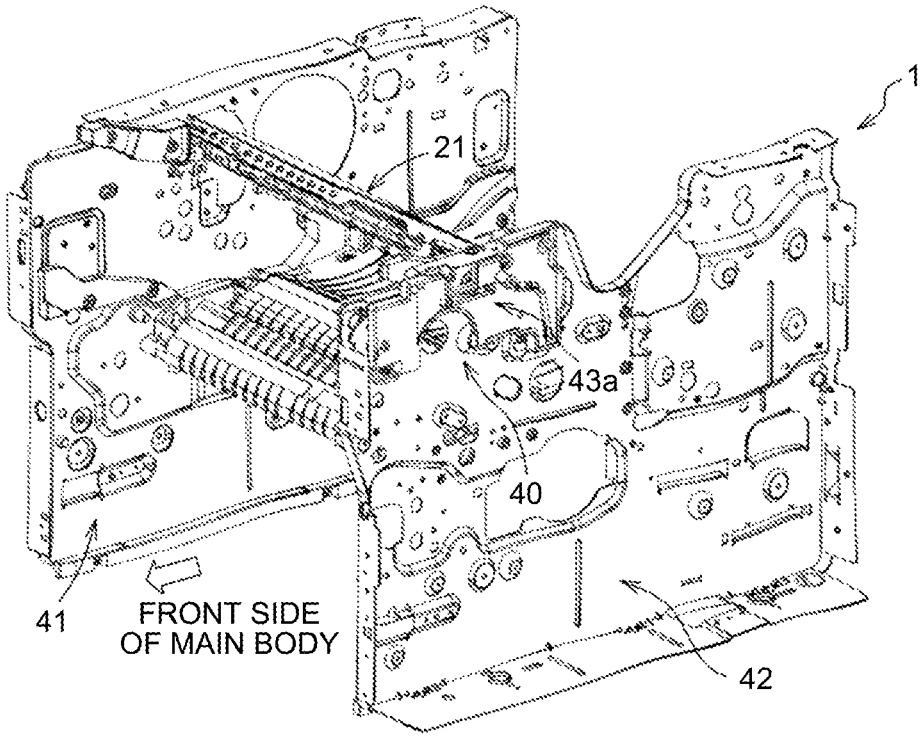
FIG. 3 shows the side walls of the main body of the image forming apparatus shown in FIG. 1.
Figure 3:
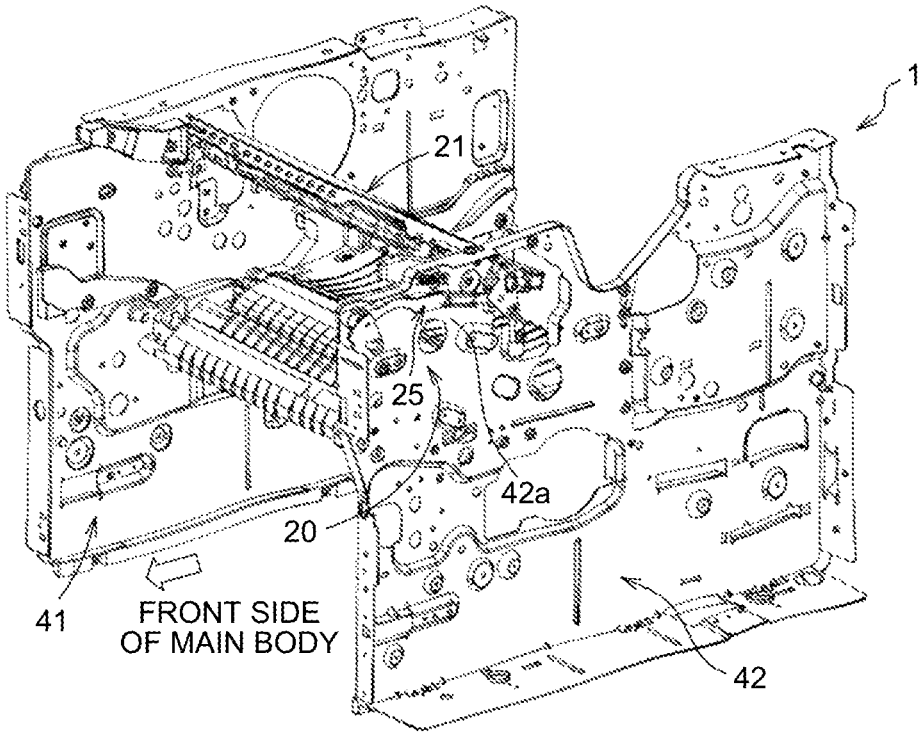
Figure 8:
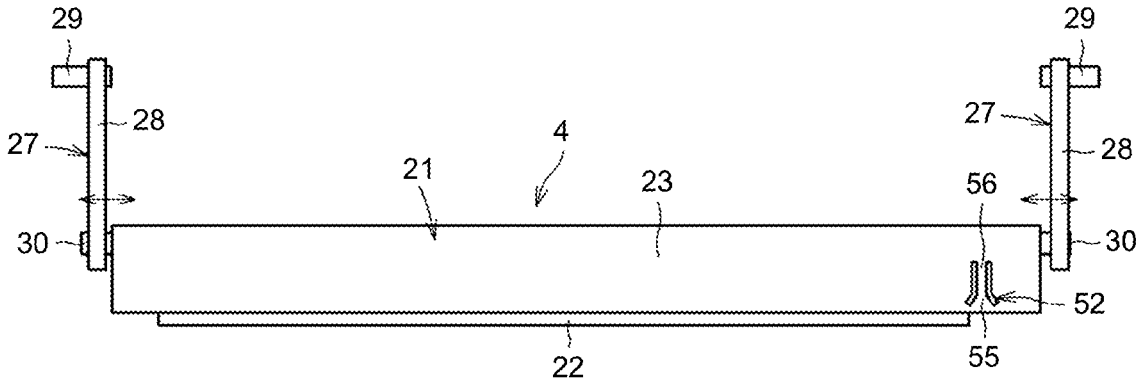
FIG. 8 is a front view of the exposure device.
Figure 9:
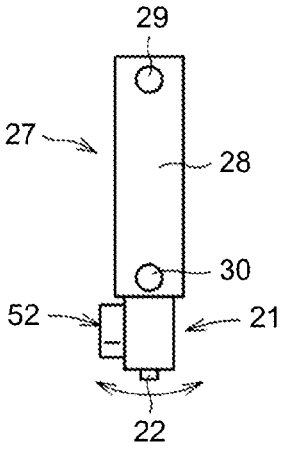
FIG. 9 is a side view of the exposure device.

The retracting mechanism 20 includes a pair of link mechanisms 25 (see FIGS. 2 and 3, etc.) which are connected to respective longitudinal ends of the LED array head 21 composing the exposure device 4. Links 26 of the link mechanisms 25 are connected to respective holding members 27 shown in FIG. 8. The holding member 27 includes a flat base plate 28 and a shaft part 29 attached to one end of the base plate 28, and a shaft part 30 projecting from each longitudinal end face of the LED array head 21 is inserted into the other end of the base plate 28. Therefore, the LED array head 21 can reciprocate with respect to the holding members 27 in their longitudinal direction (a main-scanning direction). That is, the LED array head 21 has backlash in the main-scanning direction (a main-scanning direction shown in FIG. 5). Incidentally, the LED array head 21 preferably has backlash in a sub-scanning direction perpendicular to the main-scanning direction (a sub-scanning direction shown in FIG. 5 and a direction of arrow shown in FIG. 9) in addition to backlash in the main-scanning direction.

In this case, a pair of the shaft parts 29 and 30, a pair of shaft parts (not shown), the base plate 28, and the links 26, and the like form a link mechanism having four links. This makes the LED array head 21 swing with opening-closing movement of a cover (not shown) attached to the image-forming-apparatus main body 1.

That is, the exposure device 4 is displaced between the position close to the photosensitive element 3 as an image carrier and the position distant from the photosensitive element 3. In this case, when the cover is open, the LED array head 21 is held away from the photosensitive element 3; on the other hand, when the cover is closed, the LED array head 21 is located close to the photosensitive element 3. In a state where the cover is open and the LED array head 21 is held away from the photosensitive element 3, the LED array head 21 is in a retracted state as indicated by virtual lines 21A and 21B shown in FIG. 1, so that the LED array head 21 does not interfere with the removal of the image carrier unit (process cartridge) 15 and the handling of a jam. On the other hand, when the cover is closed, the LED array head 21 is located close to the photosensitive element 3 as indicated by a solid line shown in FIG. 1, and serves as a light source for forming an electrostatic latent image.

Incidentally, as shown in FIG. 4, the link mechanisms 25 composing the retracting mechanism 20 are covered with covering members 40. The covering members 40 in this case are made up of link-mechanism opposed wall portions 41*a* and 42*b*, which are side walls 41 and 42 of the image-forming-apparatus main body 1, and guide plate members 43*a* and 43*b* opposed to the link-mechanism opposed wall portions 41*a* and 42*b*, respectively. That is, the link mechanisms 25 lie between the respective link-mechanism opposed wall portions 41*a* and 42*b* and the respective guide plate members 43*a* and 43*b*. In this case, the covering members 40 cover the link mechanisms 25 in a state where backlash of the LED array head 21 in the main-scanning direction is allowed.

A shaft part 3*a* of the photosensitive element 3 is supported by a frame 44 of the image carrier unit (process cartridge) 15 as shown in FIG. 6, etc. The frame 44 includes a pair of holding frame bodies 45*a* and 45*b*. Each of the holding frame bodies 45*a* and 45*b* is composed of a support strip portion 46 and a receiving strip portion 47; the support strip portion 46 supports the shaft part 3*a*, and the receiving strip portion 47 is confronted with the LED array head 21.

This apparatus is provided with a guide mechanism M1 and a position fixing mechanism M2; the guide mechanism M1 positions the LED array head 21 in the main-scanning direction when the LED array head 21 comes closer to the image carrier (the photosensitive element 3) through the retracting mechanism 20, and the position fixing mechanism M2 fixes the LED array head 21 in the positioned state.

Figure 7:
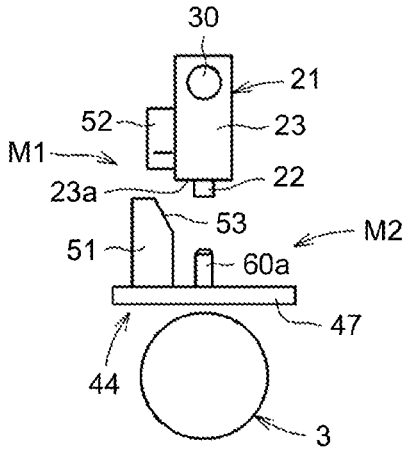
FIG. 7 is a side view showing the relationship between the image carrier unit and the exposure device.

As shown in FIGS. 6 and 7, etc., the guide mechanism M1 is composed of a male part 51 and a female part 52; the male part 51 is installed on the image carrier unit, i.e., on the photosensitive element 3 side, and the female part 52 is installed on the exposure device, i.e., on the LED array head 21 side.

Figure 12:
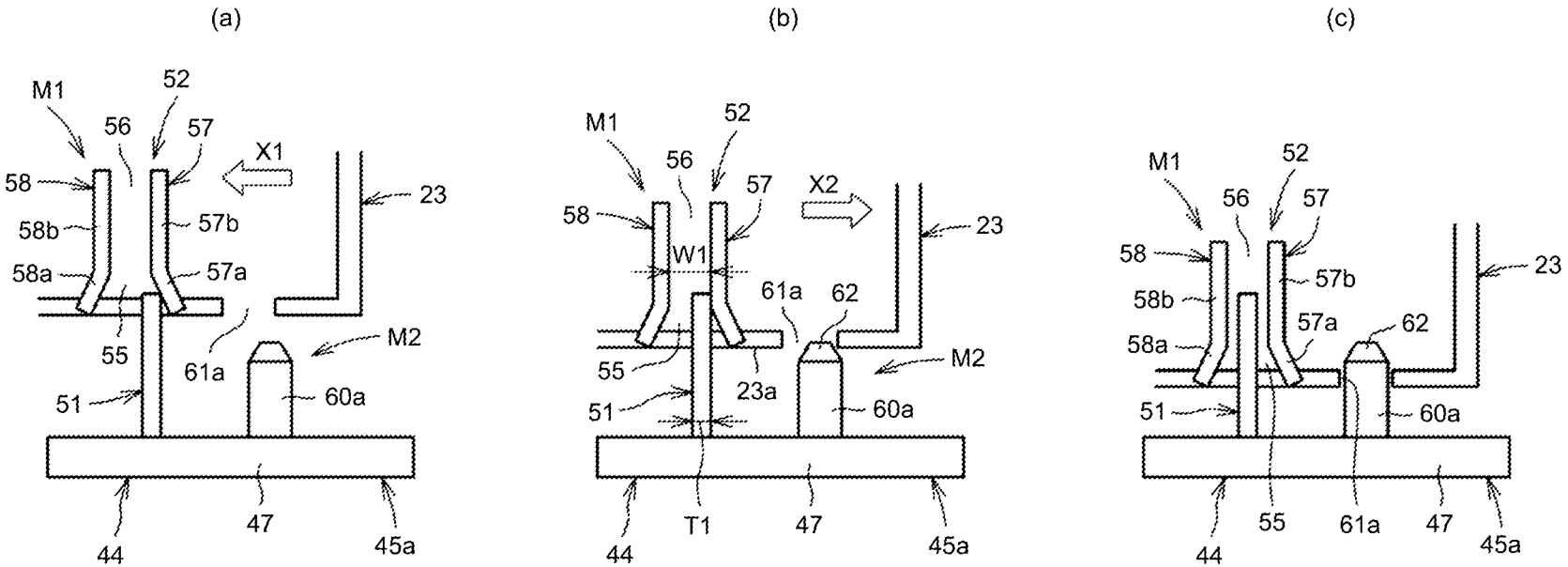
FIG. 12 shows the guide mechanism.

The male part 51 is composed of a plate-like body projecting from the receiving strip portion 47 of the holding frame body 45*a*, and a cutout portion 53 is formed in one corner of the male part 51 on the LED array head side. The female part 52 is composed of a pair of guide plate bodies 57 and 58 installed at one end (on the holding frame body 45*a* side) of the front face of the LED array head 21. This female part 52 is made up of an entrance tapered portion 55, which gradually increases in size in the main-scanning direction from the inside toward the entrance, and a male-part fitting portion 56 located more inside than the entrance tapered portion 55. That is, as shown in FIG. 12, the guide plate bodies 57 and 58 are made up of sloping portions 57*a* and 58*a* gradually decreasing in width (size in the main-scanning direction) from the entrance toward the inside, and straight portions 57*b* and 58*b* having the uniform width (size in the main-scanning direction) overall. As will be described later, this entrance tapered portion 55 serves as a guiding unit for fitting the male part 51 in the female part 52.

In this case, a width W1 of the male-part fitting portion 56 at the inside of the female part 52 is set to be larger than a thickness T1 of the male part 51 as shown in FIG. 12(*b*); therefore, when the male part 51 is fitted in the male-part fitting portion 56 of the female part 52 as shown in FIG. 12(*c*), this male part 51 is not in contact with the inner surface of the male-part fitting portion 56.

As shown in FIG. 12, the position fixing mechanism M2 is composed of pin members 60*a* and 60*b* and hole portions 61*a* and 61*b*. The pin members 60*a* and 60*b* are installed on the receiving strip portions 47 of the pair of holding frame bodies 45*a* and 45*b*, respectively. The hole portions 61*a* and 61*b* are formed on respective longitudinal ends of a bottom wall 23*a* of the LED frame 23.

Figure 10:
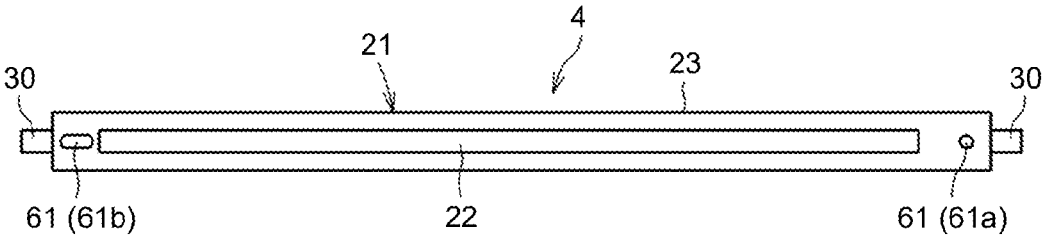
FIG. 10 is a bottom view of the exposure device.

In this case, the pin members 60*a* and 60*b* are each formed into a columnar or cylindrical body having a tapered portion 62 which gradually decreases in diameter from the base end side to the tip side. Furthermore, as shown in FIG. 10, one of the hole portions 61 (61*a*) is formed into a circular hole slightly larger than the shaft diameter of the pin member 60, and the other hole portion 61 (61*b*) is formed into an ellipsoidal hole elongated in the main-scanning direction.

Respective functions of the guide mechanism M1 and position fixing mechanism M2 configured as described above are explained below. First, in a state where the cover is open, and the LED array head 21 is held away from the photosensitive element 3, when the cover is being closed, thereby bringing the LED array head 21 closer to the photosensitive element 3 as indicated by an arrow shown in FIG. 11, if the hole portion 61*a* and the female part 52 of the guide mechanism M1 are out of alignment in a direction of an arrow X1 which is the main-scanning direction with respect to the pin member 60*a* as shown in FIG. 12(*a*), first, the male part 51 comes into contact with the inner surface of the sloping portion 57*a* of the guide plate body 57 on the pin member 60*a* side.

Then, from this state, when the LED array head 21 further comes closer to the photosensitive element 3, as the LED array head 21 allows backlash in the main-scanning direction, the male part 51 is slid as indicated by an arrow X2 shown in FIG. 12(*b*) by being guided by the inner surface of the sloping portion 57*a* of the guide plate body 57, and the male part 51 begins to be fitted in the male-part fitting portion 56 at the inside of the female part 52. That is, a guiding unit, which serves as a guide in the main-scanning direction when the LED array head 21 comes closer to the photosensitive element 3, is composed of the entrance tapered portion 55. In the state shown in FIG. 12(*b*), the tapered tip portion 62 of the pin member 60*a* of the position fixing mechanism M2 has contact with the outer circumferential edge of the hole portion 61*a* on the opposite side of the male part side. From this state, the LED array head 21 further comes closer to the photosensitive element 3, thereby the tapered tip portion 62 acts as a guiding unit, and allows the insertion of the pin member 60*a* into the hole portion 61*a* as shown in FIG. 12(*c*).

The other pin member 60*b* of the position fixing mechanism M2 is likewise allowed to be inserted into the hole portion 61*b*. In this case, the hole portion 61*b* on the pin member 60*b* side is an ellipsoidal hole, so even in an inserted state, the pin member 60*b* allows the LED array head 21 to slide in the main-scanning direction. However, the hole portion 61*a* on the pin member 60*a* side is a circular hole, so the pin member 60*a* limits the sliding movement of the LED array head 21 in the main-scanning direction and the sub-scanning direction perpendicular to the main-scanning direction. Furthermore, also at the other pin member 60*b*, the sliding movement in the sub-scanning direction is limited.

In this manner, even if the position of the LED array head 21 is out of alignment in the main-scanning direction as shown in FIG. 12(*a*), by means of the guide mechanism M1, the pin member 60*a* is inserted into the hole portion 61*b* as shown in FIG. 12(*c*), thereby positioning the LED array head 21 correctly and fixing the LED array head 21 in the positioned state.

Furthermore, when the retracting mechanism moves the LED array head 21 away from the photosensitive element 3 from the state where the LED array head 21 is positioned and fixed as shown in FIG. 12(*c*), the male part 51 of the guide mechanism M1 is gradually pulled from the female part 52, and the pin members 60*a* and 60*b* of the position fixing mechanism M2 are gradually pulled from the hole portions 61*a* and 61*b*, and thereby the LED array head 21 is allowed to move away from the photosensitive element 3.

The image forming apparatus configured as described above can hold the exposure device (the LED array head 21) close to the image carrier (the photosensitive element 3) when the image carrier unit (process cartridge) 15 is housed in the image forming apparatus, and can move the exposure device (the LED array head 21) away from the image carrier (the photosensitive element 3) when the image carrier unit (process cartridge) 15 is being housed into or removed from the image forming apparatus. Therefore, when the image carrier unit (process cartridge) 15 is removed from the image-forming-apparatus main body 1 or when the image carrier unit (process cartridge) 15 is housed into the image-forming-apparatus main body 1, the exposure device (the LED array head 21) is held away from the image carrier (the photosensitive element 3), so that the exposure device (the LED array head 21) does not interfere with the housing and removal of the image carrier unit (process cartridge) 15.

Consequently, the work efficiency of replacement and maintenance of the image carrier unit 15 can be improved. The retracting mechanism 20 is covered with the covering members 40, and this prevents a user or the like from directly touching the retracting mechanism 20 and malfunction of the retracting mechanism 20, and therefore, it is possible to prevent unintended movement of the exposure device 4. Meanwhile, backlash in the main-scanning direction (a longitudinal direction of the exposure device 4) inevitably occurs due to the installation of the covering members 40; however, by the installation of the guide mechanism M1, the exposure device 4 is fixed in the regular position when the exposure device 4 has been set, and therefore the exposure device 4 fulfills the function stably. That is, this image forming apparatus is capable of both preventing the user from touching the retracting mechanism 20 and fixing the exposure device 4 in the regular position in the main-scanning direction.

The retracting mechanism 20 includes the pair of link mechanisms 25 which are connected to the respective longitudinal ends of the exposure device 4; therefore, the retracting mechanism 20 can be build up with simple structure, and the swinging movement of the retracting mechanism 20 is stabilized.

The covering members 40 are made up of the link-mechanism opposed wall portions 41*a* and 42*b* of the side walls 41 and 42 of the image-forming-apparatus main body 1, and the guide plate members 43*a* and 43*b* opposed to the link-mechanism opposed wall portions 41*a* and 42*b*, and the link mechanisms lie between the link-mechanism opposed wall portions 41*a* and 42*b* and the guide plate members 43*a* and 43*b*; therefore, the covering members 40 can stably cover the link mechanisms 25.

In the apparatus including the position fixing mechanism M2, the exposure device 4 can be fixed and set in the steady position by inserting the pin members 60*a* and 60*b* installed on the photosensitive element 3 into the hole portions 61*a* and 61*b* formed on the LED array head 21 in a state where the alignment in the main-scanning direction is established.

As the tips of the pin members 60*a* and 60*b* of the position fixing mechanism M2 are the tapered portions 62, when the pin members 60*a* and 60*b* are inserted into the hole portions 61*a* and 61*b*, the tapered portions come in sliding contact with the opening of the hole portions, and allow the pin members 60*a* and 60*b* to be inserted into the hole portions 61*a* and 61*b*; therefore, the pin members 60*a* and 60*b* can be smoothly inserted into the hole portions 61*a* and 61*b*.

The guide mechanism M1 has the entrance tapered portion 65 composing the guiding unit, and therefore allows the steady positioning in the main-scanning direction.

The male-part fitting portion 56 of the female part 52 has the uniform size in the scanning direction overall; therefore, in the state where the positioning in the scanning direction has been performed, the male part 51 is fitted in the male-part fitting portion 56. Furthermore, in the state where the male part 51 is fitted in the male-part fitting portion 56 of the female part 52, the male part 51 is not in contact with the inner surface of the male-part fitting portion 56; therefore, when the pin members 60*a* and 60*b* of the position fixing mechanism M2 are inserted into the hole portions 61*a* and 61*b*, the fitting of the male part 51 in the female part 52 of the guide mechanism M1 is not affected.

Figure 13:
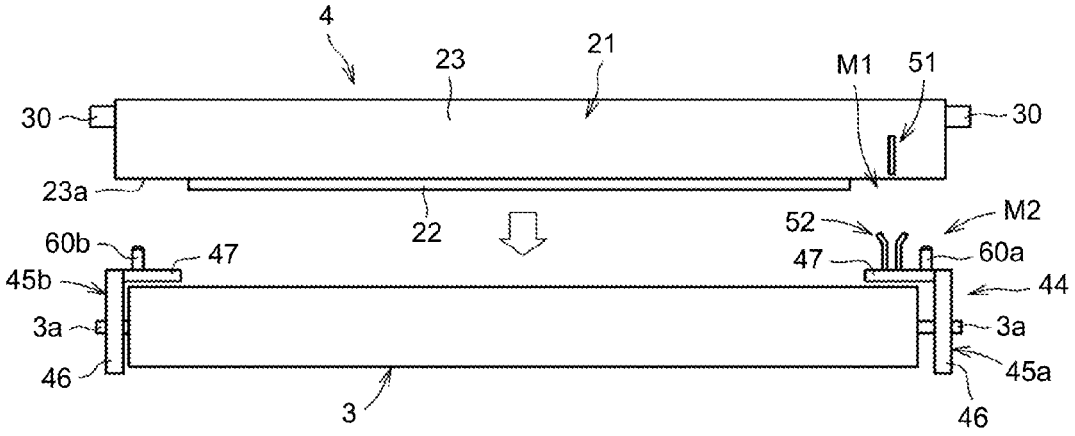
FIG. 13 is a front view of another guide mechanism.
Figure 14:
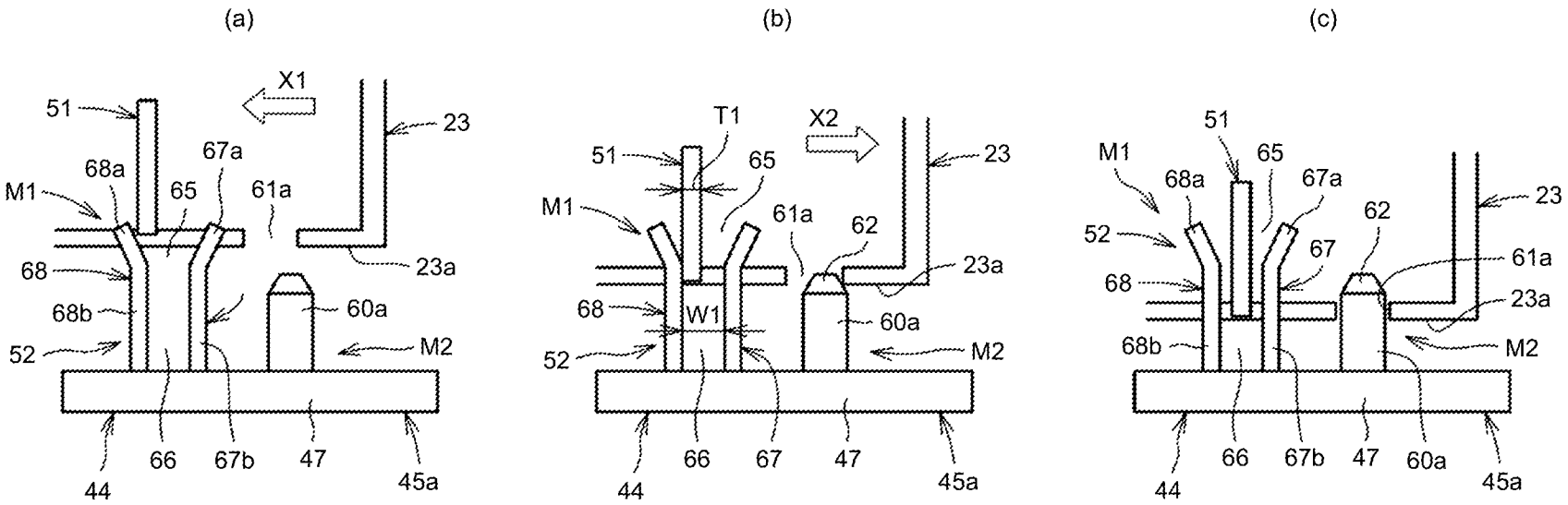
FIG. 14 shows the guide mechanism shown in FIG. 13.

Incidentally, in the above-described embodiment, the male part 51 of the guide mechanism M1 is installed on the photosensitive element, and the female part 52 is installed on the LED array head 21; alternatively, the installation locations of the male part 51 and the female part 52 may be reversed as shown in FIGS. 13 and 14.

In this case, the male part 51 composed of a plate-like body is installed at one end (on the holding frame body 45*a* side) of the front face of the LED array head. Furthermore, as shown in FIG. 14, the female part 52 is composed of a pair of guide plate bodies 67 and 68 installed on the receiving strip portion 47 of the holding frame body 45*a*. This female part 52 is also made up of an entrance tapered portion 65, which gradually increases in size in the scanning direction from the inside toward the entrance, and a male-part fitting portion 66 located more inside than the entrance tapered portion 65. That is, as shown in FIG. 14, the guide plate bodies 67 and 68 are made up of sloping portions 67*a* and 68*a* that gradually decrease in width (size in the main-scanning direction) from the entrance toward the inside, and straight portions 67*b* and 68*b* having the uniform width (size in the main-scanning direction) overall, respectively. The entrance tapered portion 65 serves as the guiding unit in the main-scanning direction when fitting the male part 51 in the female part 52.

Also in this case, the width W1 of the male-part fitting portion 56 at the inside of the female part 52 is set to be larger than the thickness T1 of the male part 51; therefore, when the male part 51 is fitted in the male-part fitting portion 66 of the female part 52 as shown in FIG. 14(*c*), this male part 51 is not in contact with the inner surface of the male-part fitting portion 66.

Subsequently, respective functions of the guide mechanism M1 and position fixing mechanism M2 configured as described above are explained below. First, in a state where the cover is open, and the LED array head 21 is held away from the photosensitive element 3, as the cover is closed, the LED array head 21 comes closer to the photosensitive element 3, and if the hole portion 61*a* and the female part 52 of the guide mechanism M1 are out of alignment in a direction of an arrow X1 which is the main-scanning direction with respect to the pin member 60*a* as shown in FIG. 14(*a*), first, the male part 51 comes into contact with the inner surface of the sloping portion 68*a* of the guide plate body 68 on the opposite side of the pin member 60*a* side.

Then, from this state, as the LED array head 21 further comes closer to the photosensitive element 3, since the LED array head 21 allows backlash in the main-scanning direction, the male part 51 is slid as indicated by an arrow X2 shown in FIG. 14(*b*) by being guided by the inner surface of the sloping portion 68*a* of the guide plate body 68, and the male part 51 is beginning to be fitted in the male-part fitting portion 66 at the inside of the female part 52. That is, a guiding unit, which serves as a guide in the main-scanning direction when the LED array head 21 comes closer to the photosensitive element 3, is composed of the entrance tapered portion 65. In the state shown in FIG. 14(*b*), the tapered tip portion 62 of the pin member 60*a* of the position fixing mechanism M2 has contact with the outer circumferential edge of the hole portion 61*a* on the opposite side of the male part side, and from this state, the LED array head 21 further comes closer to the photosensitive element 3, thereby allowing the insertion of the pin member 60*a* into the hole portion 61*a* as shown in FIG. 14(*c*).

The other pin member 60*b* of the position fixing mechanism M2 is likewise allowed to be inserted into the hole portion 61*b*. Therefore, like as the position fixing mechanism M2 shown in FIGS. 11 and 12, the sliding movement of the LED array head 21 in the main-scanning direction and the sub-scanning direction perpendicular to the main-scanning direction are limited in this way. Furthermore, also at the other pin member 60*b*, the sliding movement in the sub-scanning direction is limited.

In this manner, even if the position of the LED array head 21 is out of alignment in the main-scanning direction as shown in FIG. 14(*a*), by means of the guide mechanism M1, the pin member 60*a* is inserted into the hole portion 61*b* as shown in FIG. 14(*c*), thereby positioning the LED array head 21 correctly and fixing the LED array head 21 in the positioned state. Furthermore, when the retracting mechanism moves the LED array head 21 away from the photosensitive element 3 from the state where the LED array head 21 is positioned and fixed as shown in FIG. 14(*c*), the male part 51 of the guide mechanism M1 is gradually pulled from the female part 52, and the pin members 60*a* and 60*b* of the position fixing mechanism M2 are gradually pulled from the hole portions 61*a* and 61*b*, thereby the LED array head 21 is allowed to move away from the photosensitive element 3.

Figure 11:
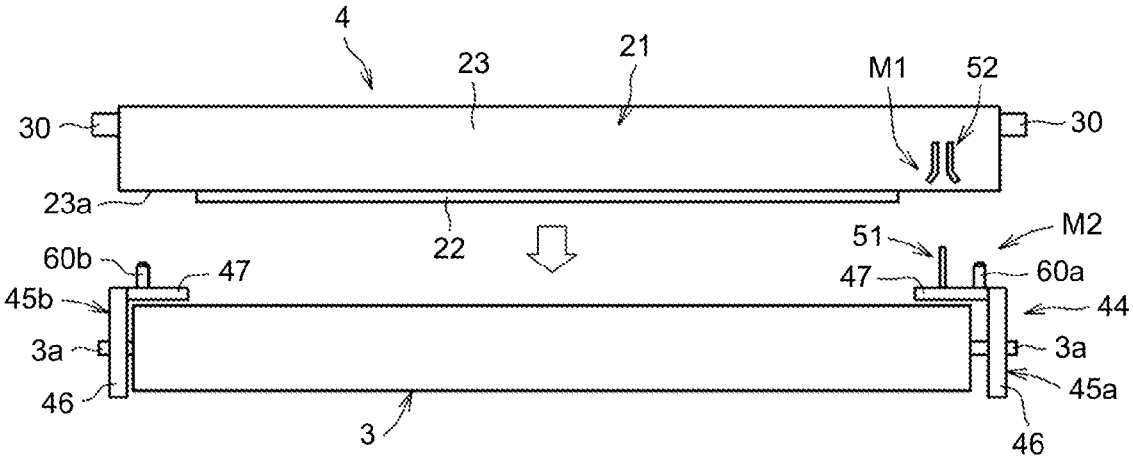
FIG. 11 is a front view showing the relationship between the image carrier unit and the exposure device before a guide mechanism guides the image carrier unit.

Therefore, the guide mechanism M1 shown in FIGS. 13 and 14 can also achieve the effect like as the guide mechanism M1 shown in FIGS. 11 and 12. That is, in the guide mechanism M1, the male part 51 may be installed on the exposure device 4, and the female part 52 may be installed on the image carrier unit; on the contrary, the male part 51 may be installed on the image carrier unit 15, and the female part 52 may be installed on the exposure device.

Incidentally, the present invention is not limited to the above-described embodiment, and, needless to say, various modifications can be made without departing from the scope of the invention. Examples of the image forming apparatus according to the present invention include an electrophotographic copier, a laser beam printer, and a facsimile machine. Furthermore, the black-and-white electrophotographic image forming apparatus is described in the above embodiment; however, the present invention can be also applied to a color electrophotographic image forming apparatus.

Moreover, the guide mechanism M1 is installed on the one holding frame body 45*a*; alternatively, the guide mechanism M1 may be installed on the other holding frame body 45*b*, or can be installed at both end portions in the scanning direction. Furthermore, as the position fixing mechanism M2, the hole portion 61*a* is formed into a circular hole, and the other hole portion 61*b* is formed into an ellipsoidal hole; on the contrary, the hole portion 61*a* may be formed into an ellipsoidal hole, and the other hole portion 61*b* may be formed into a circular hole, or the both hole portions 61*a* and 61*b* may be formed into a circular hole.

Moreover, in the case where the guide mechanism M1 shown in FIG. 12 is installed, in the above embodiment, there is described the case where the LED array head 21 is out of alignment in the direction of the arrow X1; however, the LED array head 21 may be out of alignment in the direction of the arrow X2. Even when the LED array head 21 is out of alignment in the direction of the arrow X2, this guide mechanism M1 can deal with this case as well. That is, if the LED array head 21 is out of alignment in the direction of the arrow X2, as the LED array head 21 comes closer to the photosensitive element 3, first, the male part 51 comes into contact with the inner surface of the sloping portion 58*a* of the guide plate member 58 of the female part 52. From this state, as the LED array head 21 further comes closer to the photosensitive element 3, since the LED array head 21 allows backlash in the main-scanning direction, the male part 51 is slid in the direction of the arrow X1 by being guided by the inner surface of the sloping portion 58*a* of the guide plate body 58, and the male part 51 is beginning to be fitted in the male-part fitting portion 66 at the inside of the female part 52. In this state, the tapered tip portion 62 of the pin member 60*a* of the position fixing mechanism M2 has contact with the outer circumferential edge of the hole portion 61*a* on the male part side, and from this state, the LED array head 21 further comes closer to the photosensitive element 3, thereby allowing the insertion of the pin member 60*a* into the hole portion 61*a*.

Moreover, also in the case where the guide mechanism M1 shown in FIG. 14 is installed, in the above embodiment, there is described the case where the LED array head 21 is out of alignment in the direction of the arrow X1; however, the LED array head 21 may be out of alignment in the direction of the arrow X2. In this case, first, the male part 51 comes into contact with the inner surface of the sloping portion 67*a* of the guide plate body 67 on the pin member 60*a* side.

From this state, as the LED array head 21 comes closer to the photosensitive element 3, since the LED array head 21 allows backlash in the main-scanning direction, the male part 51 is slid as shown by the arrow X1 by being guided by the inner surface of the sloping portion 67*a* of the guide plate body 67, and the male part 51 is beginning to be fitted in the male-part fitting portion 66 at the inside of the female part 52. In this state, the tapered tip portion 62 of the pin member 60*a* of the position fixing mechanism M2 has contact with the outer circumferential edge of the hole portion 61*a* on the male part side, and from this state, the LED array head 21 comes closer to the photosensitive element 3, thereby allowing the insertion of the pin member 60*a* into the hole portion 61*a*.

In the above-described embodiment, as the position fixing mechanism M2, the pin members 60 are installed on the photosensitive element 3, and the hole portions 61 are formed on the LED array head 21; on the contrary, the pin members 60 may be installed on the LED array head 21, and the hole portions 61 may be formed on the photosensitive element 3.

Incidentally, backlash of the LED array head 21 in the main-scanning direction is within a range in which the male part 51 of the guide mechanism M1 comes into contact with the inner surface of the sloping portion 57*a*, 58*a*, 67*a*, 68*a* of the guide plate body 57, 67, 58, 68 of the female part 52 as the LED array head 21 comes closer to the photosensitive element 3.

In an image forming apparatus according to the embodiment, an exposure device does not interfere with the housing and removal of an image carrier unit, and therefore the work efficiency of replacement and maintenance of the image carrier unit can be improved. A retracting mechanism is covered with a covering member, and this prevents a user or the like from directly touching the retracting mechanism and malfunction of the retracting mechanism, and therefore, it is possible to prevent unintended movement of the exposure device. Meanwhile, backlash in a main-scanning direction (a longitudinal direction of the exposure device) inevitably occurs due to the installation of the covering member; however, by the installation of a guide mechanism, the exposure device is fixed in the regular position when the exposure device has been set, and therefore the exposure device fulfills the function stably. That is, this image forming apparatus is capable of both preventing the user from touching the retracting mechanism and fixing the exposure device in the regular position in the main-scanning direction.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier unit that includes at least an image carrier and is configured to be capable of being housed in and removed from an image-forming-apparatus main body;

an exposure device as a light source that is arranged close to the image carrier to form an electrostatic latent image;

a retracting mechanism that holds the exposure device close to the image carrier when the image carrier unit is housed in the image-forming-apparatus main body, and holds the exposure device away from the image carrier when the image carrier unit is being removed from the image-forming-apparatus main body;

a covering member that covers the retracting mechanism in a state where backlash of the exposure device at least in a main-scanning direction is allowed; and a guide mechanism that positions the exposure device in the main-scanning direction when the exposure device comes closer to the image carrier through the retracting mechanism.

2. The image forming apparatus according to claim 1, wherein the retracting mechanism includes a pair of link mechanisms which are connected to respective longitudinal ends of the exposure device, the covering member is made up of link-mechanism opposed wall portions of side walls of the image-forming-apparatus main body, and guide plate members opposed to the respective link-mechanism opposed wall portions, and the link mechanisms lie between the respective link-mechanism opposed wall portions and the respective guide plate members.

3. The image forming apparatus according to claim 1, further comprising a position fixing mechanism that includes a pin member installed on one of the image carrier unit and the exposure device and a hole portion which is formed on the other of the image carrier unit and the exposure device and allows insertion of the pin member thereinto in a state where positions of the hole portion and the pin member in the main-scanning direction are aligned.

4. The image forming apparatus according to claim 3, wherein a tip of the pin member of the position fixing mechanism is a tapered portion which tapers from a base end toward the tip, and when the pin member is inserted into the hole portion, the tapered portion has sliding contact with an opening of the hole portion, thereby allowing insertion of the pin member into the hole portion.

5. The image forming apparatus according to claim 1, wherein the guide mechanism includes a male part installed on one of the image carrier unit and the exposure device and a female part installed on the other of the image carrier unit and the exposure device, and the male part is fitted in the female part while the exposure device is slid in the main-scanning direction when the exposure device comes closer to the image carrier, and thereby the female part is fitted with the male part.

6. The image forming apparatus according to claim 5, wherein the female part of the guide mechanism includes a guiding unit that serves as a guide in the main-scanning direction when the exposure device comes closer to the image carrier.

7. The image forming apparatus according to claim 5, wherein the female part is composed of an entrance tapered portion, which gradually increases in size in the main-scanning direction from an inside toward an entrance, and a male-part fitting portion located more inside than the entrance tapered portion.

8. The image forming apparatus according to claim 7, wherein the male-part fitting portion of the female part has an uniform size in the main-scanning direction overall.

9. The image forming apparatus according to claim 7, wherein when the male part is fitted in the male-part fitting portion of the female part, the male part is not in contact with an inner surface of the male-part fitting portion of the female part.

10. The image forming apparatus according to claim 5, wherein the male part of the guide mechanism is installed on the exposure device, and the female part of the guide mechanism is installed on the image carrier unit.

11. The image forming apparatus according to claim 5, wherein the male part of the guide mechanism is installed on the image carrier unit, and the female part of the guide mechanism is installed on the exposure device.

* * * * *